United States Patent [19]

de Bie et al.

[11] 4,117,367

[45] Sep. 26, 1978

[54] HIGH-PRESSURE DISCHARGE LAMP

[75] Inventors: Jan Rudolf de Bie; Tjepke Hendrik Ekkelboom; Johannes Jacobus Franciscus Geytenbeek; Willem Lodewijk van Hoorn; Otmar Schob, all of Eindhoven, Netherlands

[73] Assignee: U.S. Philips Corporation, New York, N.Y.

[21] Appl. No.: 600,149

[22] Filed: Jul. 29, 1975

[30] Foreign Application Priority Data

May 13, 1974 [NL] Netherlands ..... 7406379

[51] Int. Cl.[2] ..... H01J 1/02; H01J 1/14; H01J 1/38; H01K 1/04

[52] U.S. Cl. ..... 313/352; 75/214; 313/217; 29/421 R

[58] Field of Search ..... 313/217, 218, 346, 352; 29/421, 40, DIG. 92; 75/214

[56] References Cited

U.S. PATENT DOCUMENTS

| | | | |
|---|---|---|---|
| 2,932,882 | 4/1960 | Kelly, Jr. | 29/421 X |
| 3,054,014 | 9/1962 | Gemsa | 313/352 |
| 3,113,234 | 12/1963 | Schlegel | 313/217 |
| 3,286,337 | 11/1966 | Sauve | 29/421 X |
| 3,331,685 | 7/1967 | Brown et al. | 75/214 |
| 3,404,978 | 10/1968 | Koppius | 75/214 X |
| 3,416,919 | 12/1968 | Snow et al. | 75/214 X |
| 3,471,287 | 10/1969 | Roberts, Jr. | 75/214 X |
| 3,577,635 | 5/1971 | Bergman et al. | 75/214 |
| 3,621,322 | 11/1971 | Rehmet | 313/218 |
| 3,633,264 | 1/1972 | Gripschover et al. | 29/421 |
| 3,649,224 | 3/1972 | Anderson et al. | 75/214 |
| 3,650,736 | 3/1972 | Broom | 75/214 |
| 3,741,755 | 6/1973 | Allen | 29/421 |

FOREIGN PATENT DOCUMENTS

| | | | |
|---|---|---|---|
| 252,476 | 10/1969 | U.S.S.R. | 318/218 |

*Primary Examiner*—Saxfield Chatmon, Jr.
*Attorney, Agent, or Firm*—Frank R. Trifari; Robert S. Smith

[57] ABSTRACT

A high-pressure discharge lamp having at least one electrode fabricated by an isostatic compression process.

1 Claim, 3 Drawing Figures

HIGH-PRESSURE DISCHARGE LAMP

The invention relates to a high-pressure discharge lamp provided with electrodes made of a refractory material, such as tungsten and tantalum carbide and mixtures thereof, and possibly an activating material. The invention relates in particular to electrode-stabilised discharge lamps, i.e. lamps in which the electrode spacing is smaller than the diameter of the envelope.

The invention further relates to a method of manufacturing electrodes for a high-pressure discharge lamp and to electrodes obtained by this method. Commonly used gas fillings for lamps of this type mainly consist of xenon or mercury or mixtures of xenon and mercury. The electrodes of such a high-pressure discharge lamp may contain an activating material, such as thorium oxide, which serves to reduce the work function. In a lamp operated with direct current the activating material is mainly disposed in the cathode. Electrodes for high-pressure discharge lamps generally are made by pressing powdered tungsten, to which activating material may be admixed, into a rod, sintering the rod, hammering and drawing the sintered product and shaping the resulting member into the desired electrode form by machining. In general sintering is effected at temperatures above about 2,600° C. In the process, part of the activating material may evaporate. This evaporation loss must be allowed for when selecting the type and the amount of the activating material, and also care must be taken to ensure that the tungsten does not loose its machinability by the addition of the activating material. For example, for the latter reason the amount of thorium oxide in the tungsten to be machined should not greatly exceed about 2% by weight and must certainly not be more than 5% by weight. This means that in some cases the optimum amount for the best type of activating material cannot be used. Electrodes made by the method described show marked recrystallisation of the tungsten, starting from the point at which the arc attaches to the electrode. Owing to this recrystallisation the number of grain boundaries decreases, with the result that the arc does no longer burn stably because the point of attachment to the electrode is continually moving. This phenomenon is particularly troublesome when the lamp is used for projection purposes, because unstable burning of the arc causes the illumination of the projection screen to be irregular and to vary continually.

The instability of the arc after a given time of operation may be explained as follows: the surface of the cathode is provided with activating material which reduces the work function. During the operation of the lamp activating material is continuously vaporising. However, fresh activating material can only be supplied by diffusion from the interior of the electrode along the grain boundaries. If initially a large number of grain boundaries are present at the surface of the electrode, evaporation of the activating material will not immediately cause unstable burning of the arc. When, however, the number of grain boundaries at the surface is reduced by recrystallisation, this supply of activating material is impeded and the number of points at which the work function is reduced decreases. Consequently when the activating material is evaporated at the point of attachment of the arc, the latter will shift to another area of the electrode at which the amount of activating material still is sufficient.

In the operation of the lamp much heat is generated in the electrodes. The conduction of this heat via the current leads to the places at which these conductors enter the fused-silica envelope should be a minimum. If the temperature of these places is too high, unequal expansion of the metal current leads and the material of the envelope wall may cause the envelope to crack, in particular when the lamp is switched on or switched off. For these reasons, generally in high-pressure discharge lamps comparatively long current leads are used, and in spite of the small arc size this leads to a comparatively large lamp size, whilst especially in direct-current lamps the anode surface is given a specific shape which promotes heat radiation. The conduction of heat to the current lead may also be impeded by forming constrictions in the electrode body. The said two steps may be used simultaneously. It has also been proposed to provide the anode with a layer which improves the heat radiation of the surface, for example a layer of tantalum carbide. It is stated that in this manner in a grooved anode the operating temperature of the point of attachment of the arc is 80° C. to 140° C. lower than in an anode having a volume which is greater by 15% and in which the said steps are not used.

However, in this anode construction also, marked recrystallisation of the tungsten will occur which may give rise to unstable burning of the arc. Another possibility is to produce a given surface roughness by etching or sandblasting. However, the resulting roughness generally is insufficiently homogeneous and involves the risk of incorporation of impurities.

It is an object of the present invention to provide a high-pressure discharge lamp in which these disadvantages are avoided.

According to the invention this is achieved by a high-pressure discharge lamp which is characterized in that at least one of the electrodes is directly obtained in the desired external shape by isostatic pressing of a powder of a desired composition.

In the process generally referred to as isostatic pressing a powder is compressed with a pressure which is uniformly distributed throughout its surface area in a compressible mould made, for example, of rubber or a synthetic material. The pressure is transferred by a fluid. The isostatic pressure process may be carried out at normal temperature or at an elevated temperature.

It was found that electrodes which by the isostatic pressure process are directly obtained with the desired outer shape have properties which render them particularly suited for use in high-pressure discharge lamps. It was found that the surface of such an electrode has a higher emissive power than the surface of a conventional electrode obtained by rotation-symmetrical machining of a sintered and deformed tungsten billet. This results in improved heat dissipation by radiation so that with equal lamp construction the end of the lead which passes through the envelope wall will be colder. This permits either imposing a higher load on the lamp or maintaining the load and using a smaller electrode and envelope. It also permits the choice of a simpler electrode shape while retaining the same lamp construction.

It was further found that the crystal structure of the electrodes obtained by the isostatic pressure process is retained during operation of the lamp (electrode peak temperature higher than 2,200° C.). Even prolonged testes (<500 hours) show only slight grain growth. There is no marked recrystallisation at all. The advantage of maintaining the fine-crystalline structure during the entire useful life of the lamp consists in that the number of grain boundaries remains substantially constant, enabling activating material to be supplied from the interior of the electrodes by diffusion along the grain boundaries during the entire life of the lamp. Furthermore stable burning of the arc is ensured. Attendant advantages, which however under certain circumstances may prove of high importance, are that a freer choice is possible with regard to the composition of the material of which the electrodes are made, to the amount and the type of the activating material and to the shape of the electrodes. For example, in direct-current lamps an anode shape may be used which offers maximum area of contact to the gases evolved without giving rise to eddies which may cause local overheating of the anode. In a preferred embodiment which in this respect is particularly satisfactory in practice, the anode has the shape of a rocket and is formed with recesses which are uniformly distributed around the circumference of the cylindrical part and are bounded by axially extending edges and faces which form parts of the circumferences of cones the axes of which coincide with the axis of the anode. There may, for example, be four such recesses. The invention further permits the use of electrodes which have local differences in material composition. For example, the activating material may be contained in an entirely enclosed chamber in the electrode. Furthermore the tip of the electrode may be made of another material, or have another composition, than the remainder. According to a further feature of the invention electrodes for high-pressure discharge lamps are made mainly of tungsten and, if desired, an activating material by a method which is characterized in that a powder of the desired composition is placed in a mould adaptd to be compressed throughout its entire surface area, the powder is isostatically compressed at ambient temperature to the desired shape and the resulting electrode is subjected to a sintering treatment at a temperature above 2,000° C.

Suitable pressures for carrying out such a method lie between $5 \times 10^4$ N/cm$^2$. When using tungsten powders having grain sizes of 4 μm to 15 μm, for example, a pressure of about $15 \times 10^4$ N/cm$^2$ yields members the density of which is between 85% and 88% of the theoretical density. Short-time sintering of these members at a temperature above 2,000° C., for example, for 15 minutes at 2,400° C., permits of obtaining a density of about 92% of the theoretical value. For comparison it should be mentioned that in electrodes made by the conventional manufacturing process the density after sintering as a rule is 86% of the theoretical density and reaches a value of 92% of the theoretical density only by deformation (rolling and hammering).

When very high pressures are used in the process according to the invention a short heat treatment at a temperature which will be reached by the electrode during operation of the lamp is sufficient.

Emobodiments of the invention will now be described, by way of example, with reference to the accompanying diagrammatic drawings, in which.

Figure 1:
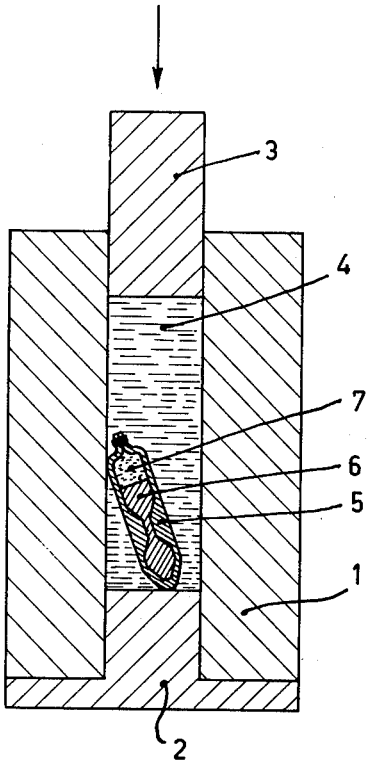
FIG. 1 is a schematic sectional view of a machine for applying isostatic pressure.

Referring now to FIG. 1, a press shown schematically and in section comprises a thick-walled pressure chamber 1, a bottom 2 and a plunger 3, all made of steel. The pressure chamber contains a liquid 4, for example petrol. Placed in the chamber is a mould 5 which is adapted to be compressed throughout its entire surface area and contains a powdered refractory material 6 and a compressible member 7. The mould 5 is obtained by immersing a jig having the desired electrode shape into liquid latex and drying the deposited rubber skin. The rubber mould 5 is filled with the powder to be compressed, using a vibration treatment to ensure dense stacking, after which a compressible member 7, for example made of cork, is placed on the powder. The mould 5 then is evacuated and hermetically sealed by typing. By moving the plunger 3 in the direction indicated by the arrow pressure is exerted on the mould 5 in the pressure chamber throughout the entire surface. After the compressing operation the resulting members are heated in a hydrogen atmosphere.

Figure 2:
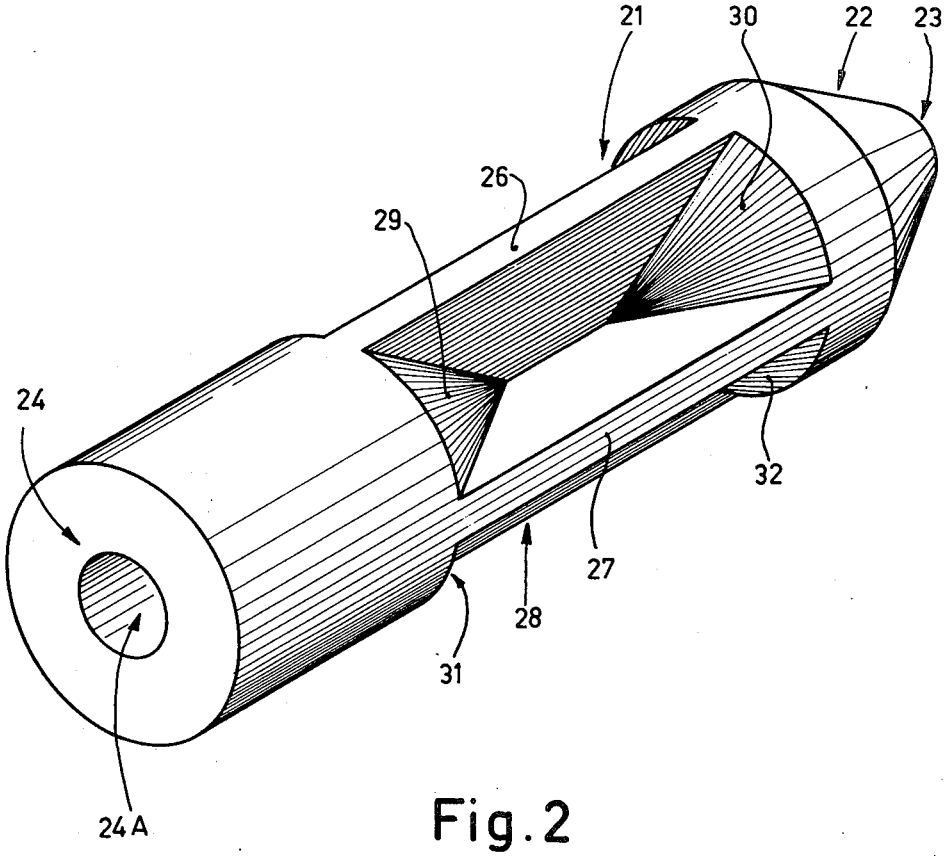
FIG. 2 shows an anode made by the machine of FIG. 1.

FIG. 2 is a perspective view to an enlarged scale of a preferred embodiment of a tungsten anode for use in a direct-current lamp, which anode is made by an isostatic compression process. A rocket-shaped body 21 which is generally cylindrical has a conical end 22 which is truncated, the end face 23 forming the area of attachment of the arc. At the opposite end 24 a blind hole 24*A* is formed for receiving the current supply rod. The anode body 21 has four recesses which are uniformly distributed around the circumference and are bounded by edges which extend at right angles to one another and three of which (26, 27 and 28) can be seen in the Figure, and by faces which form parts of the circumference of cones and four of which (29, 30, 31 and 32) are indicated in the Figure. The recesses serve to present a maximum contact area to the gases flowing past the electrode, without eddies being produced which may give rise to local overheating. The hole 24*A* is formed after the compression operation, preferably prior to a subsequent temperature treatment. In the operation of the lamp, on an anode as shown in FIG. 2 having an overall length of 2.6 cm a temperature difference of about 1,000° C. was measured between the area of attachment 23 of the arc and the opposite end 24 at a temperature of the area 23 of about 2,600° C.

Figure 3:
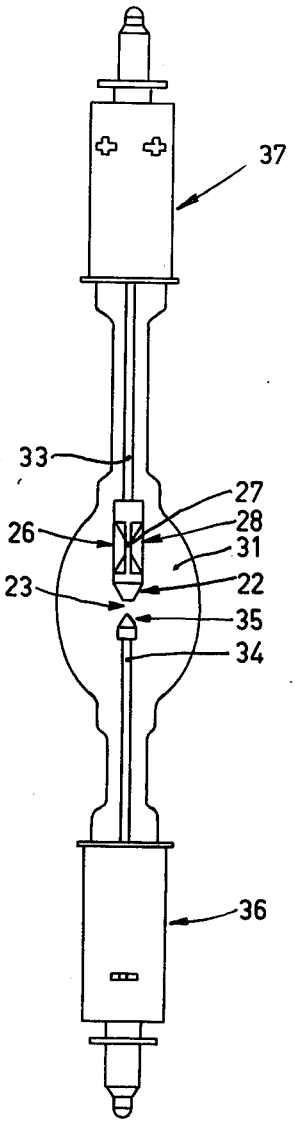
FIG. 3 shows a high-pressure discharge lamp.

The lamp shown in FIG. 3 is a short-arc xenon discharge lamp which in operation consumes a power of about 450 watts. The lamp is a direct-current lamp and has a tungsten anode body 21 enclosed in a fused-silica discharge vessel 31 filled with xenon to a pressure of 12 atmospheres. (Reference numerals 23, 26, 27 and 28 have the same meanings as in FIG. 2). The anode 21 is secured to a tungsten current lead 33 which is led out in a gas-tight manner. A cathode 35 made of tungsten containing 1.5% by weight of $ThO_2$ which serves as emissive material is made by an isostatic compression process similar to that used for the anode 21. The cathode 35 is secured to a tungsten current lead 34. The current leads are connected to lamp caps 36 and 37. When an anode 21 as shown in FIG. 2 is used the temperature of the lamp cap 37 is found to be about 50° C. less than when using an electrode of equal length which was formed with grooves in its circumference and was made by a conventional method. This shows that the lamp according to the invention can be loaded more heavily before the temperature in the lamp caps rises to the same value as in lamps having electrodes manufactured by conventional methods. This means that when isostatically compressed electrodes are used, while retaining to the same load, shorter current leads 33 and 34 can be used so that the lamp size can be reduced. When maintaining the temperature of the lamp caps 36 and 37 this means that the lamp can be loaded more heavily, thus permitting a higher light output as compared with a lamp of the same size using conventional electrodes.

What is claimed is:

1. A high-pressure discharge lamp which comprises a discharge tube and an anode and a cathode, said anode being made of a refractory material including materials selected from the group consisting of tungsten and tantalum carbide, said anode being made in the desired external shape from a powder of the desired composition by an isostatic compression process, said anode being generally cylindrical with one end generally conical and having recesses which are uniformly distributed around the circumference of the cylindrical part, said recesses being bounded by axially extending edges and faces which form parts of the circumferences of said anode, the axes of said edges and faces being parallel to the axis of said anode.

* * * * *